US005921623A

United States Patent [19]

Nye et al.

[11] Patent Number: 5,921,623

[45] Date of Patent: Jul. 13, 1999

[54] FOLDABLE PICNIC TABLE WITH TELESCOPING PEDESTALS

[75] Inventors: Stephen F. Nye, Roy; Carl Stanford, Clinton; Glenn Merrill, Ogden, all of Utah

[73] Assignee: Lifetime Products, Inc., Clearfield, Utah

[21] Appl. No.: 09/058,584

[22] Filed: Apr. 10, 1998

Related U.S. Application Data

[63] Continuation of application No. 08/369,549, Jan. 6, 1995, abandoned.

[51] Int. Cl.[6] ..... A47B 83/02

[52] U.S. Cl. ..... 297/158.4; 297/159.1; 108/132

[58] Field of Search ..... 297/158.4, 159.1; 248/188.5; 108/144, 132, 133, 27

[56] References Cited

U.S. PATENT DOCUMENTS

| | | |
|---|---|---|
| 769,354 | 9/1904 | Nielsen . |
| 1,063,642 | 6/1913 | Birdsall . |
| 1,272,187 | 7/1918 | Basford . |
| 1,296,336 | 3/1919 | Stine . |
| 1,351,013 | 8/1920 | Stine . |
| 1,514,418 | 11/1924 | Battenfeld . |
| 1,594,572 | 8/1926 | Soltesz . |
| 1,659,840 | 2/1928 | Smith . |
| 1,823,484 | 9/1931 | Blumenthal . |
| 2,109,869 | 3/1938 | Ross . |
| 2,257,550 | 9/1941 | Gay . |
| 2,411,658 | 11/1946 | La Rue . |
| 2,452,169 | 10/1948 | Wells . |
| 2,512,473 | 6/1950 | Alch . |
| 2,522,642 | 9/1950 | Schmidt . |
| 2,524,198 | 10/1950 | La Rue . |
| 2,548,682 | 4/1951 | Price . |
| 2,558,465 | 6/1951 | Seymour . |
| 2,568,622 | 9/1951 | Hagan . |
| 2,579,934 | 12/1951 | Krasney . |
| 2,583,247 | 1/1952 | Aja et al. . |
| 2,621,710 | 12/1952 | Miller . |
| 2,647,562 | 8/1953 | Hoffar . |
| 2,661,792 | 12/1953 | Lysaght . |
| 2,670,031 | 2/1954 | Melges . |
| 2,690,210 | 9/1954 | Holick . |
| 2,717,028 | 9/1955 | Villemure . |
| 2,717,631 | 9/1955 | Howe . |
| 2,722,971 | 11/1955 | Gallagher et al. . |
| 2,748,837 | 6/1956 | Beller . |
| 2,752,987 | 7/1956 | Smithers . |
| 2,766,812 | 10/1956 | Schrader . |
| 2,771,937 | 11/1956 | Wilson . |
| 2,780,506 | 2/1957 | Howe . |
| 2,788,059 | 4/1957 | Mackintosh . |
| 2,800,379 | 7/1957 | Smithers . |
| 2,805,708 | 9/1957 | Bohn . |
| 2,811,197 | 10/1957 | Nimmo . |
| 2,811,400 | 10/1957 | James . |
| 2,825,390 | 3/1958 | Post . |
| 2,837,141 | 6/1958 | Shore . |
| 2,849,053 | 8/1958 | Beller et al. . |
| 2,878,589 | 3/1959 | Howe et al. . |
| 2,936,820 | 5/1960 | Blink et al. . |

(List continued on next page.)

FOREIGN PATENT DOCUMENTS

| | | |
|---|---|---|
| 650758 | 11/1964 | Belgium . |

*Primary Examiner*—Peter M. Cuomo
*Assistant Examiner*—Anthony D. Barfield
*Attorney, Agent, or Firm*—Madson & Metcalf

[57] ABSTRACT

A foldable picnic table is shown. The foldable picnic table includes a table top supported by two support pedestals pivotally attached to the table top. Each support pedestal is capable of telescoping engagement. The foldable picnic table also includes benches attached to the pedestals by bench support members. The foldable picnic table includes means for locking the table in an extended position. When the support pedestals are retracted, the pedestals and the attached bench supports can pivot inwardly toward the table top such that the entire unit is substantially flat.

22 Claims, 8 Drawing Sheets

U.S. PATENT DOCUMENTS 2,939,516 6/1960 Drew .
2,939,518 7/1960 Drew ..... 297/159.1
2,959,209 11/1960 Lakin .
2,978,754 4/1961 Wilson .
2,983,308 5/1961 Horowitz .
2,992,043 7/1961 Nelson .
3,025,120 3/1962 Howe .
3,027,209 3/1962 Nielsen .
3,079,197 2/1963 Mugler .
3,080,193 3/1963 Nimmo .
3,096,866 7/1963 Glass .
3,101,062 8/1963 Kanzelberger .
3,112,954 12/1963 Kanitz .
3,141,424 7/1964 Seymour .
3,174,796 3/1965 Brown .
3,191,991 6/1965 Anderson et al. .
3,256,037 6/1966 Giambalvo .
3,259,426 7/1966 Shaw et al. .
3,273,936 9/1966 Deavers ..... 297/159.1
3,276,815 10/1966 Cardy .
3,337,262 8/1967 Katzfey et al. .
3,357,729 12/1967 Krueger ..... 108/130
3,410,232 11/1968 Krueger .
3,429,283 2/1969 Uhor .
3,545,738 12/1970 Stagg .
3,574,393 4/1971 Hughes .
3,580,632 5/1971 Seymour .
3,650,560 3/1972 Wohlk .
3,672,719 6/1972 Haukedahl .
3,692,358 9/1972 Sung .
3,731,971 5/1973 Sjogren .
3,765,719 10/1973 Silver .
3,788,696 1/1974 Loewen .
3,797,884 3/1974 Gutierrez .
3,857,343 12/1974 Greenburg .
3,885,829 5/1975 Haeger .
3,893,400 7/1975 Grant .
3,994,527 11/1976 Nikitits et al. .
4,040,658 8/1977 Mayol .
4,043,277 8/1977 Wallace .
4,047,754 9/1977 Cathey .
4,052,100 10/1977 Nikitits et al. .
4,060,275 11/1977 Hansen .
4,064,812 12/1977 Commanda .
4,070,057 1/1978 Jones .
4,111,482 9/1978 Jones .
4,131,311 12/1978 Nikitits et al. .
4,157,089 6/1979 Loughrey .
4,191,111 3/1980 Emmert ..... 108/133
4,249,773 2/1981 Giambalvo .
4,289,350 9/1981 Thomas et al. .
4,330,151 5/1982 Healey ..... 297/157.1
4,382,627 5/1983 Dean .
4,415,199 11/1983 Wright .
4,489,661 12/1984 Fitzgerald .
4,537,443 8/1985 Bray .
4,572,574 2/1986 Fischhaber et al. .
4,596,196 6/1986 Gunter et al. .
4,606,575 8/1986 Kodet .
4,648,652 3/1987 Van Kuren .
4,653,804 3/1987 Yoo et al. .
4,700,987 10/1987 Sraka et al. .
4,744,309 5/1988 Kiesel et al. .
4,762,321 8/1988 Chang .
4,774,309 9/1988 Kiesel et al. ..... 108/27
4,826,244 5/1989 Choi .
4,883,314 11/1989 Sakong .
4,960,303 10/1990 York .
5,007,673 4/1991 Cheng .
5,018,785 5/1991 Monson et al. .
5,029,938 7/1991 Song .
5,109,778 5/1992 Bekowitz et al. .
5,240,307 8/1993 Jones et al. .
5,314,231 5/1994 Otterbacher .
5,325,793 7/1994 Martin .
5,411,314 5/1995 Wallace .

FOLDABLE PICNIC TABLE WITH TELESCOPING PEDESTALS

RELATED APPLICATION

This application is a continuation of our application Ser. No. 08/369,549, filed on Jan. 6, 1995 for FOLDABLE PICNIC TABLE WITH TELESCOPING PEDESTALS, now abandoned.

BACKGROUND

1. The Field of the Invention

The present invention is related to a picnic table. More particularly, the present invention is related to a foldable picnic table with telescoping pedestals.

2. Technical Background

Picnic tables offer the convenience of having a table and seating for the table combined into one unit. Picnic tables also offer the advantage of being able to seat a large number of people around one table. Picnic tables are generally used outdoors and have become increasingly popular as more and more people spend their leisure time outside. Picnic tables can be found in backyards, parks, campsites, and various other places. Picnic tables are also used indoors, primarily to provide temporary seating. They are often used in cafeterias, gymnasiums, homes, and other places.

Leaving a picnic table outside subjects it to potentially damaging elements which could shorten the life span of the picnic table. Thus, it is often desirable to be able to store the picnic table in a protected area. The often temporary nature of indoor picnic table use also creates a need to be able to store the table after using it. Unfortunately, most picnic tables are too bulky to store conveniently. Thus, it is desirable to have a foldable picnic table which can be collapsed for convenient storing.

Some foldable picnic tables require separate pieces to secure the picnic table in an unfolded position. These pieces are susceptible to being lost. Other conventional foldable picnic tables are complex in design, requiring simultaneous folding of the table's support pedestals. This can be a cumbersome task. Another disadvantage of conventional foldable picnic tables is that many are made with diagonal support braces or bench supports which limit the leg space of a person seated at the table. Many of the existing foldable picnic tables are uncomfortable to use either because of the flat benches or the sharp edges of the table.

From the foregoing, it will be appreciated that it would be an advancement in the art to provide a foldable picnic table that is fully self contained and does not have detachable parts. It would be another advancement in the art to provide a foldable picnic table that can be folded, one side at a time, thereby reducing the complexity of operation. It would also be an advancement in the art to provide a foldable picnic table that maximizes the amount of leg room for a person sitting anywhere at the table. Finally, it would be an advancement in the art to provide a comfortable foldable picnic table at which to sit.

Such a foldable picnic table is disclosed and claimed herein.

BRIEF SUMMARY OF THE INVENTION

The present invention is directed to a novel foldable picnic table. The picnic table of the present invention includes a table top supported by two pedestals. Each support pedestal is pivotally attached to the table top. The support pedestals include telescoping supports, each having an inner and an outer member connected in telescoping engagement in which the outer member and inner member slide relative to each other. This configuration permits the telescoping supports to change the length of the support pedestals between an extended and retracted position. The foldable picnic table also has means for locking the table in the extended position.

In a preferred embodiment, the foldable picnic table has two benches. A bench support member is attached to one support pedestal and pivotally attached to one end of both benches about a first axis of rotation. A second bench support member is attached to the second support pedestal and pivotally attached to the other end of both benches about a second axis of rotation.

When the foldable picnic table is in the extended position, the table top is in a different plane than the benches. When the foldable picnic table is in the retracted position, the axis of rotation between the first support pedestal and the table top, established by their pivotal connection, is collinear with the first axis of rotation. Likewise, the axis of rotation between the second support pedestal and the table top is collinear with the second axis of rotation. When the pedestals are in a retracted position, the support pedestals and the attached bench support members can be moved between a perpendicular position, in which the support pedestals and bench support members are disposed perpendicular to the table top, and a folded position, in which the support pedestals and bench support members are folded into substantially the same plane as the table top.

The table top includes a frame and a counter which fits snugly over the frame. In the preferred embodiment, the frame is made of metal and the counter is made of plastic. The table top counter of the preferred embodiment has a functional surface which includes a bevelled outer edge to increase the comfort of one resting an arm against the edge of the table top. The table top counter also has a mounting surface configured to match the contour of the frame over which it fits. The table top counter is attached to the frame by conventional methods.

Each bench, in a preferred embodiment, includes a bench frame and a bench counter. Like the table top, the bench frame is made of metal and the bench counter is made of plastic. The bench counter preferably has a sitting surface which is flat with bevelled longitudinal edges. The bench also has a mounting surface which fits snugly over the contour of the frame.

The preferred embodiment of the present invention includes a diagonal brace connecting each support pedestal to the table top. The diagonal brace can be folded allowing each pedestal to pivot toward the table top. The brace is also lockable in the extended position.

In a preferred embodiment, the means for locking the pedestals in the extended position consists of a snap pin mechanism. The inner and outer members of the telescoping supports are configured with a hole. The holes are positioned to align with each other when the telescoping support is in the extended position. The snap pin is biased outwardly through the holes when they are aligned, thereby preventing relative movement of the inner and outer members. The user, upon application of a sufficient force, may remove the snap pin from engagement through the hole in the outer member. This action unlocks the pedestals, thereby permitting relative movement between the inner and outer members of the telescoping support.

In an alternative embodiment, the means for locking the pedestals in an extended position includes a cross brace. The cross brace extends between the two telescoping supports and consists of a pair of latches positioned in a channel. The latches are biased outwardly by a spring and extend into holes disposed with the telescoping supports and aligned together when the pedestal is in an extended position. This prevents relative movement between the inner and outer members. Each latch is configured with an actuation pin spaced sufficiently close to each other such that both pins can be grasped by one hand. As the actuation pins are squeezed together, the latches disengage the holes and the inner and outer members of the telescoping supports can move relative to each other.

From the foregoing, it will be appreciated that the present invention provides a foldable picnic table that does not require separate pieces to function properly. It also provides a foldable picnic table that can be folded, one side at a time, reducing the complexity of operation. Finally, the present invention provides a foldable picnic table that maximizes the amount of leg room for a person sitting anywhere at the table.

These and other advantages of the present invention will become more fully apparent by examination of the following description of the preferred embodiments and the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
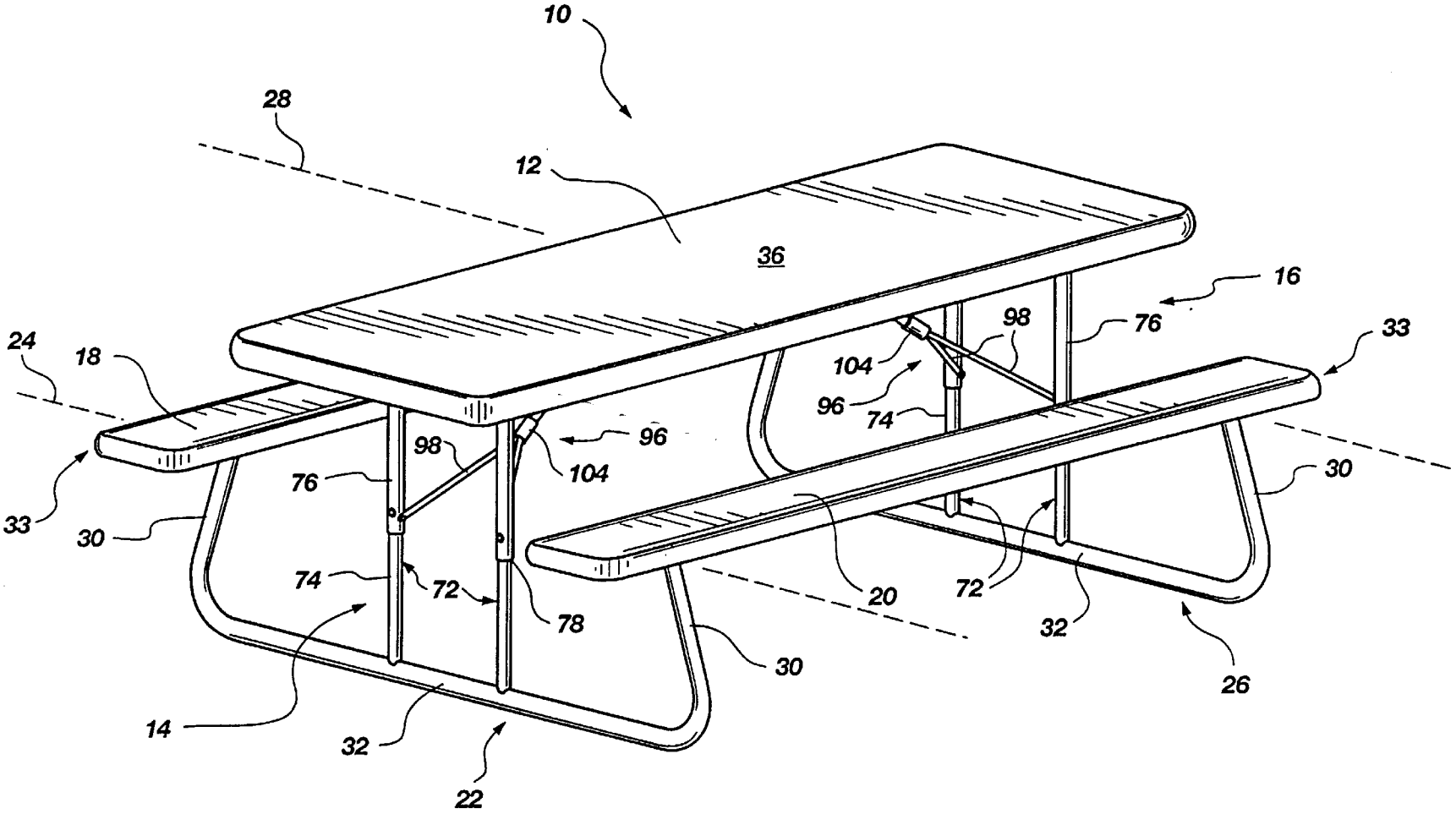
FIG. 1 is a perspective view of one embodiment of the foldable picnic table of the present invention with the pedestals in the extended position.

Reference is now made to the figures wherein like parts are referred to by like numerals throughout. With particular reference to FIG. 1, a foldable picnic table according to the present invention is generally designated at 10.

The foldable picnic table 10 includes a table top 12 supported by a first support pedestal 14 and a second support pedestal 16. The foldable picnic table 10 further includes a first bench 18 and a second bench 20. A first bench support member 22 is attached to the first support pedestal 14 and pivotally attached to the first bench 18 and to the second bench 20 about a first axis of rotation 24. A second bench support member 26 is attached to the second support pedestal 16 and pivotally attached to the first bench 18 and to the second bench 20 about a second axis of rotation 28. Each bench support member 22, 26 has two end segments 30 joined by a substantially horizontal segment 32. The horizontal segment 32 is positioned substantially perpendicular to, and beneath, each bench 18, 20. Each bench 18, 20 includes an outer longitudinal edge 33. The horizontal segment 32 of each bench support member 22, 26 extends from at least the outer longitudinal edge 33 of the first bench 18 to at least the outer longitudinal edge 33 of the second bench 20. The end portion 30 of each bench support member 22, 26 is attached to a corresponding bench 18, 20 and extends outwardly to the horizontal segment 32. This configuration leaves an unobstructed area directly beneath the bench for increased foot space.

Figure 2A:
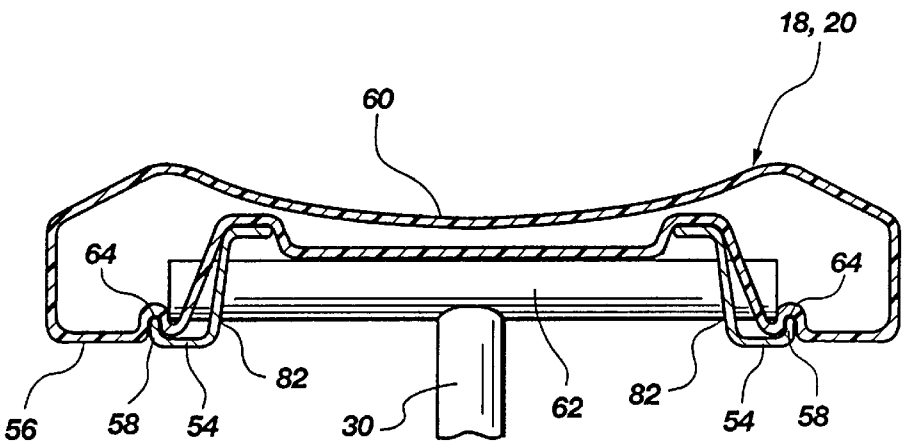
FIG. 2A is a cross-sectional plan view showing an alternative embodiment of the bench of FIG. 1.
Figure 2:
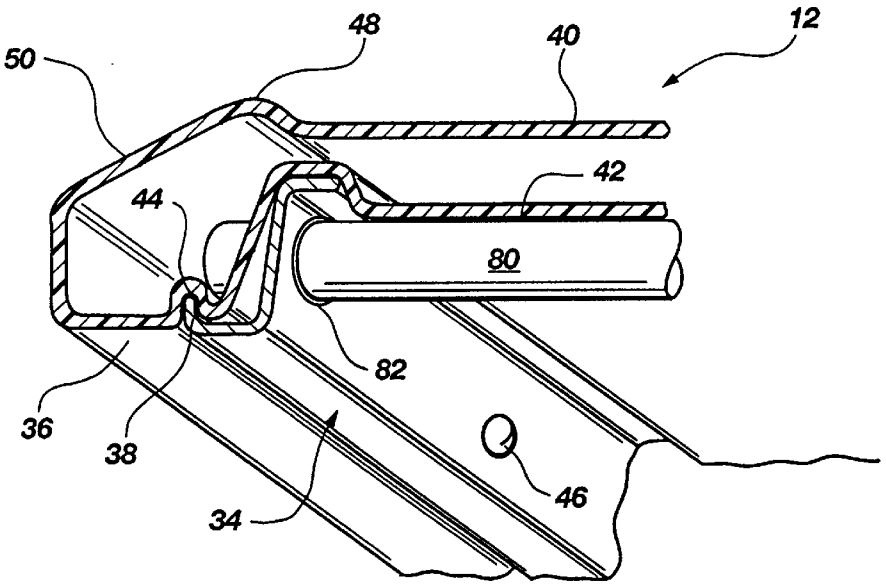
FIG. 2 is a perspective cutaway view of the foldable picnic table of FIG. 1.

With reference now to FIG. 2, the table top 12 includes a table top frame 34 and a table top counter 36. In a preferred embodiment, the table top frame 34 is generally rectangular. The frame 34 consists of a metal support having a substantially S-shaped cross-section. One end of the S-shaped cross-section has a locking lip 38 to help secure the snug fit of the table top counter 36 over the frame 34.

The table top counter 36 is a substantially hollow shell, preferably blow-molded out of plastic, which includes a functional surface 40 and a mounting surface 42. As illustrated in the embodiment of FIG. 2, the mounting surface 42 of the table top counter 36 is configured to conform generally to the shape of the table top frame 34. The table top counter 36 of the preferred embodiment fits snugly over the table top frame 34 and includes a notch 44 in which the locking lip 38 of the frame 34 fits. The table top frame 34 is attached to the table top counter 36 by means of fasteners 46 which penetrate both the table top frame 34 and an adjacent point of the mounting surface 42. It will be appreciated that a variety of shapes may be used for the table top frame 34 and the mounting surface 42 of the table top counter 36. Additionally, the means of attaching the frame 34 to the counter 36 is conventional in the art. Various attachment methods may be employed including rivets, screws, or bolts.

FIG. 2 illustrates one embodiment of the functional surface 40 of the table top counter 36. In this embodiment, the functional surface 40 has a raised perimeter 48 configured such that things spilled on the functional surface 40 of the table top counter 36 will not drip over the edge of the table top 12. The perimeter 48 extends approximately one sixteenth of an inch above the functional surface 40 of the table top counter 36. In a preferred embodiment, the outer edges 50 of the functional surface 40 of the table top counter 36 are bevelled at approximately a fifteen degree angle to increase the comfort of a person resting their arm against the edge of the table top 12.

FIG. 2A also illustrates a cutaway view of one of the benches 18, 20. The benches each include a bench frame 54 and a bench counter 56. Each bench frame 54 in the preferred embodiment has a substantially S-shaped cross-section. Like the table top frame 34, one end of the S-shaped cross-section of the bench frame 54 is configured with a locking lip 58. The bench counter 56 is a substantially hollow blow-molded shell of the same material as the table top counter 36. The bench includes a sitting surface 60 and a mounting surface 62. As illustrated in FIG. 2A, the mounting surface 62 of the bench counter 56 is configured to conform generally to the shape of the bench frame 54. The bench counter 56 fits snugly over the bench frame 54 and includes a notch 64 in which the locking lip 58 of the frame 54 fits. In a preferred embodiment, the bench frame 54, like the table top frame 34, is attached to the bench counter 56 by means of bench fasteners which penetrate the frame 54 and an adjacent point in the mounting surface 62. As with the table top frame and counter, it will be appreciated that a variety of configurations may be used for the bench frame 54 and mounting surface 62 of the bench counter 56. Additionally, the means employed to attach the frame 54 to the counter 56 may include any of those known in the art.

Figure 4:
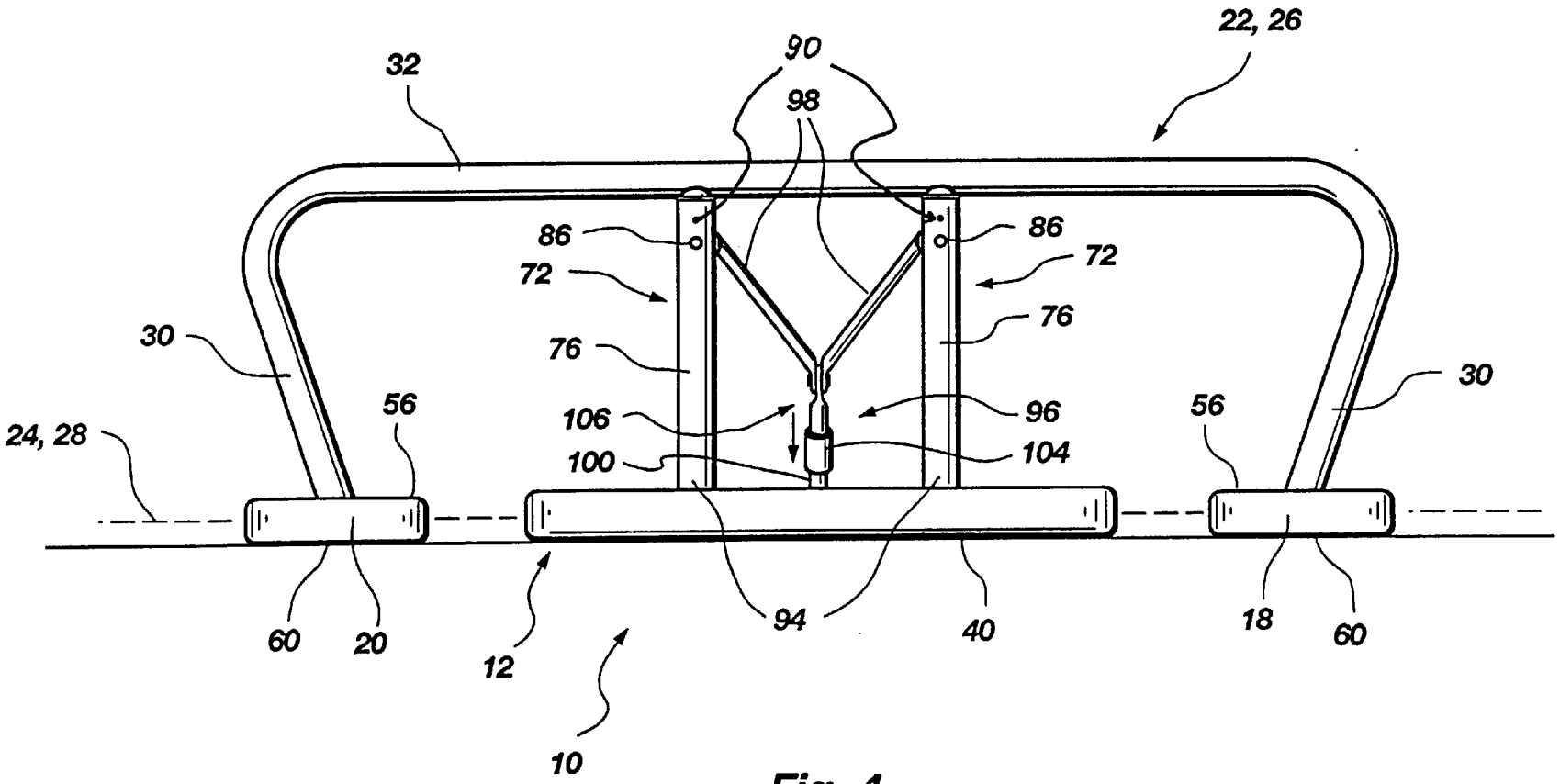
FIG. 4 is a plan end view of the foldable picnic table of FIG. 1 with the pedestals retracted.

As is best illustrated in FIG. 4, the preferred embodiment of the sitting surface 60 is flat along its length. FIG. 2A illustrates an alternative embodiment of the sitting surface 60 where the sitting surface 60 is concave along the length of the bench counter 56. FIG. 2A also illustrates how the outer edge of the sitting surface 60 of the bench counter 56 is bevelled at approximately a fifteen degree angle.

The table top frame 34 of FIG. 2 and bench frame 54 of FIG. 2A are preferably made of metal. The table top counter 36 and the bench counter 56 are preferably made of plastic. The teachings of this invention may be practiced using a variety of materials for both the table top 36 and bench 56 counters and their respective frames including, but not limited to, rubbers, composite materials, or wood.

Figure 3:
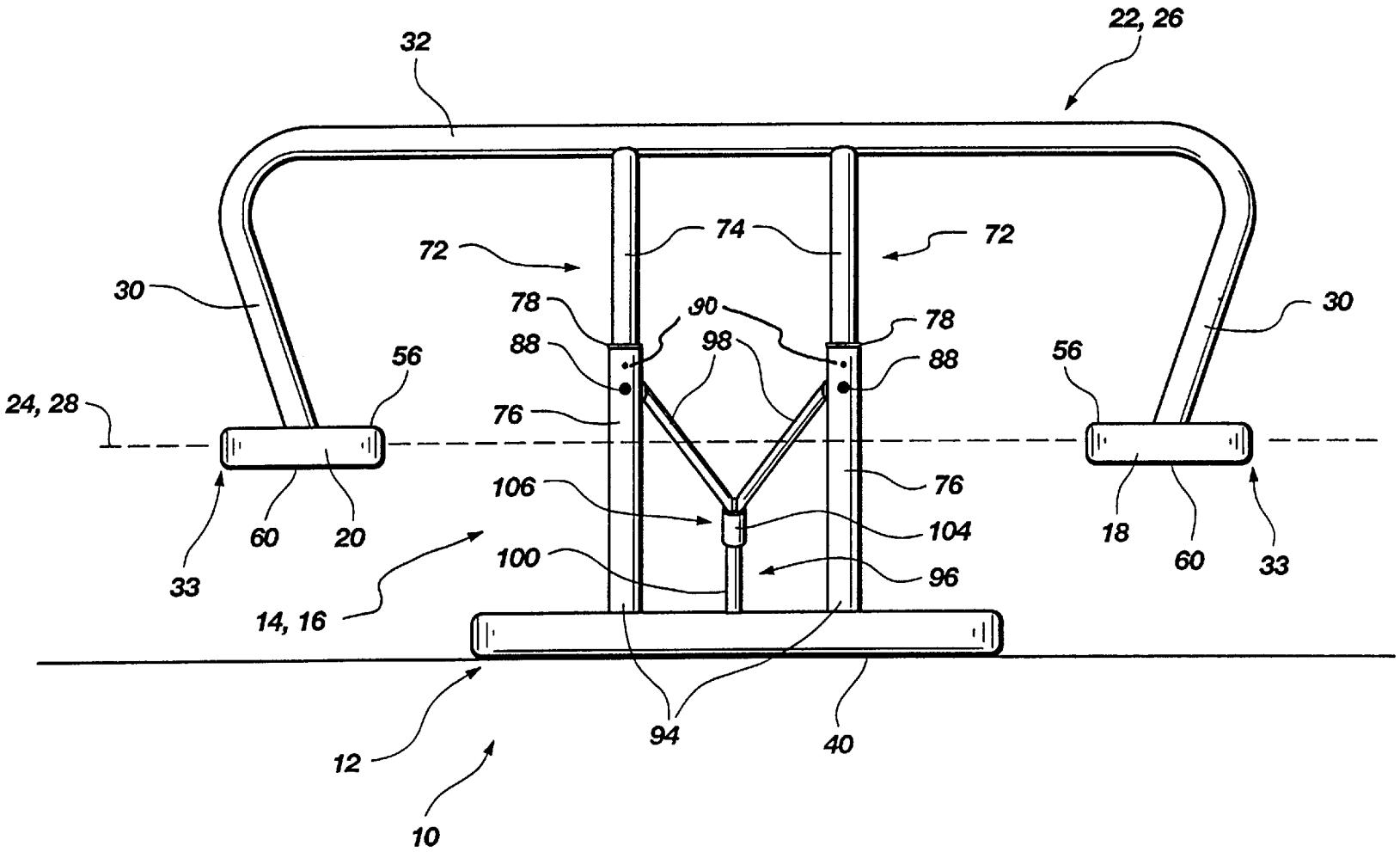
FIG. 3 is a plan end view of the inverted foldable picnic table of FIG. 1.

With reference now to FIG. 3, each support pedestal 14, 16 in their presently preferred embodiment includes two substantially parallel telescoping supports 72. It will be appreciated that the teachings of this invention can be practiced if each pedestal 14, 16 has more or less than two telescoping supports 72. Each telescoping support 72 includes an inner member 74 and an outer member 76 which, in a preferred embodiment, are separated by a hard plastic bushing 78 to facilitate the sliding of the inner member 74 into the outer member 76. Each bushing 78 is preferably held in place with two small extensions that extend through small holes 90 in the outer member 76. The bushing extends slightly beyond the edge of the outer member 76 where it flanges outwardly covering the edge of the outer member 76.

Figure 5:
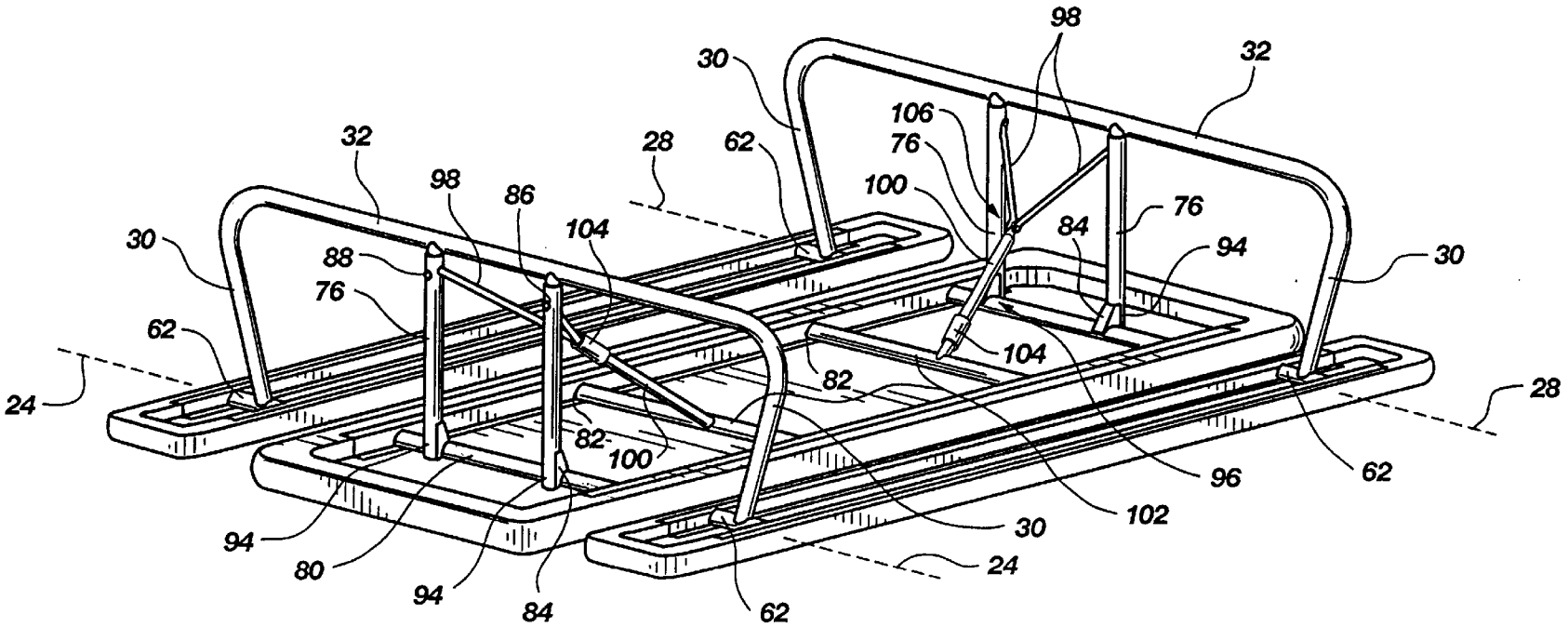
FIG. 5 is a perspective view of the foldable picnic table of FIG. 1 inverted with the pedestals in a retracted position and the diagonal brace extended.
Figure 6:
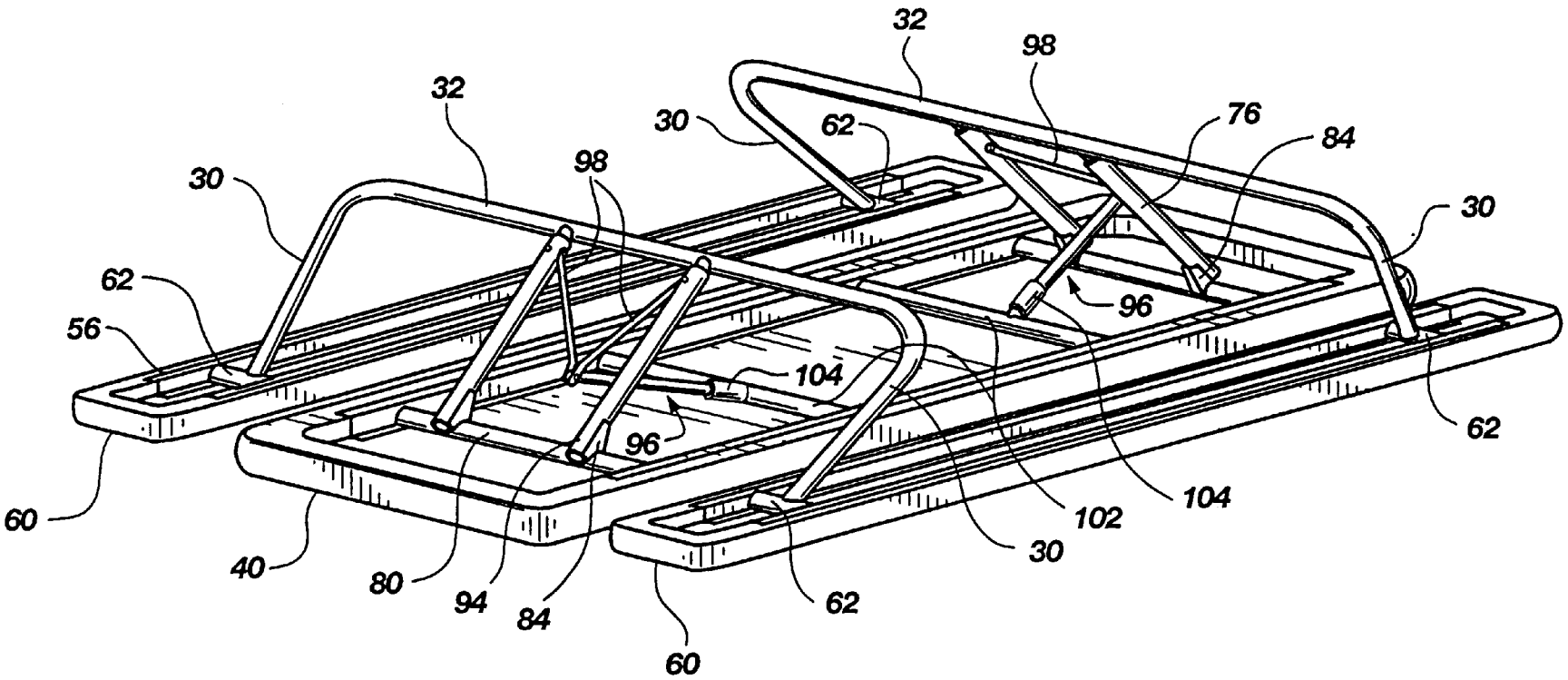
FIG. 6 is a partial perspective view of the foldable picnic table of FIG. 1 inverted with the pedestals retracted and partially folded.

The telescoping supports 72 change length so that the support pedestals 14, 16 may be moved linearly between an extended position, as illustrated in FIG. 3, whereby the table top 12 is positioned in a different plane than the benches 18, 20, and a retracted position, as illustrated in FIG. 4, whereby the table top 12 is in substantially the same plane as the benches 18, 20. In the retracted position, the axis of rotation between the first support pedestal and the table top, established by the pivotal connection between the two, is collinear with the first axis of rotation 24. Also, the axis of rotation between the second support pedestal and the table top, again established by the pivotal connection between the two, is collinear with the second axis of rotation 28 when the foldable picnic table 10 is in the retracted position. As is illustrated in FIGS. 5 and 6, when the foldable picnic table 10 is in the retracted position and the axes of rotation are aligned, the first cross poles 80 are capable of pivotal movement.

The foldable picnic table 10 has means for locking the support pedestals in an extended position. As is best illustrated in FIG. 4, the inner 74 and outer 76 members of the telescoping supports 72 in the preferred embodiment are configured with a hole 86. The holes 86 are disposed within the inner 74 and outer 76 members such that they align with each other when the telescoping supports, and thus the pedestals 14, 16, are in the extended position (FIG. 3). In a preferred embodiment, as illustrated in FIG. 3, a snap pin mechanism is positioned within each telescoping support 72 such that a pin 88 is biased outwardly through the aligned holes 86 locking each telescoping support 72 in an extended position. By supplying sufficient force to the pin 88, it may be removed from the hole 86 in the outer member 76, thereby permitting relative movement between the inner 74 and outer 76 members of the telescoping support 72 and allowing the pedestal 14, 16 to be retracted. It will be appreciated that a variety of means for locking the first 14 and second 16 support pedestals in an extended position may be utilized.

Figure 8:
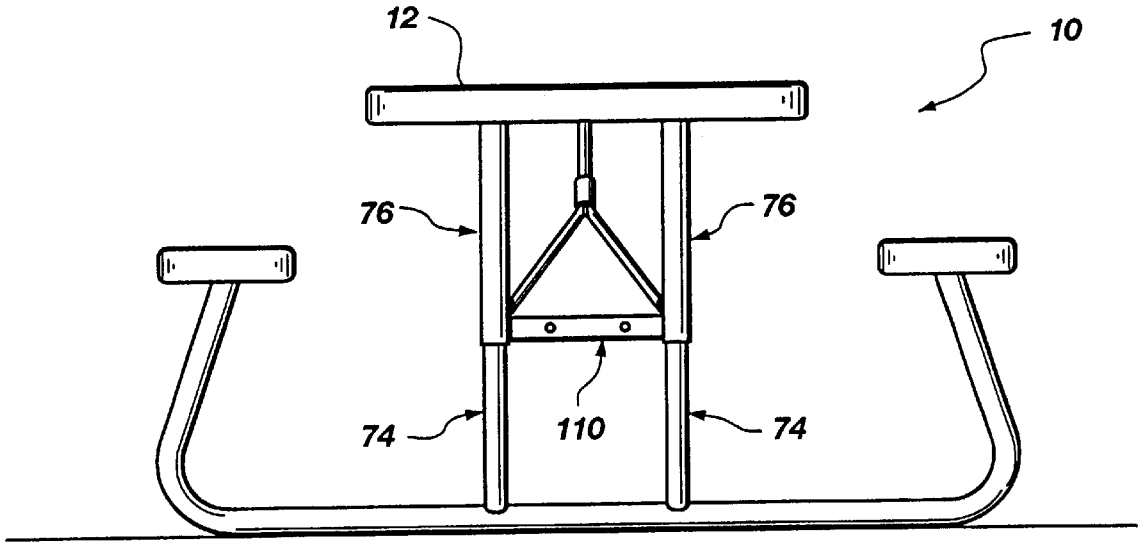
FIG. 8 is an end view of the foldable picnic table of FIG. 1 showing the cross brace locking mechanism.

With reference now to FIG. 8, an alternative means for locking the support pedestals 14, 16 in the extended position is illustrated. In this embodiment, holes are disposed within the inner 74 and outer 76 members of the telescoping supports 72 such that they align with each other and are opposite each other in the supports 72 when the pedestals 14, 16 are in the extended position. A cross brace 110 extends between the two telescoping supports 72 adjacent the holes 86.

Figure 9:
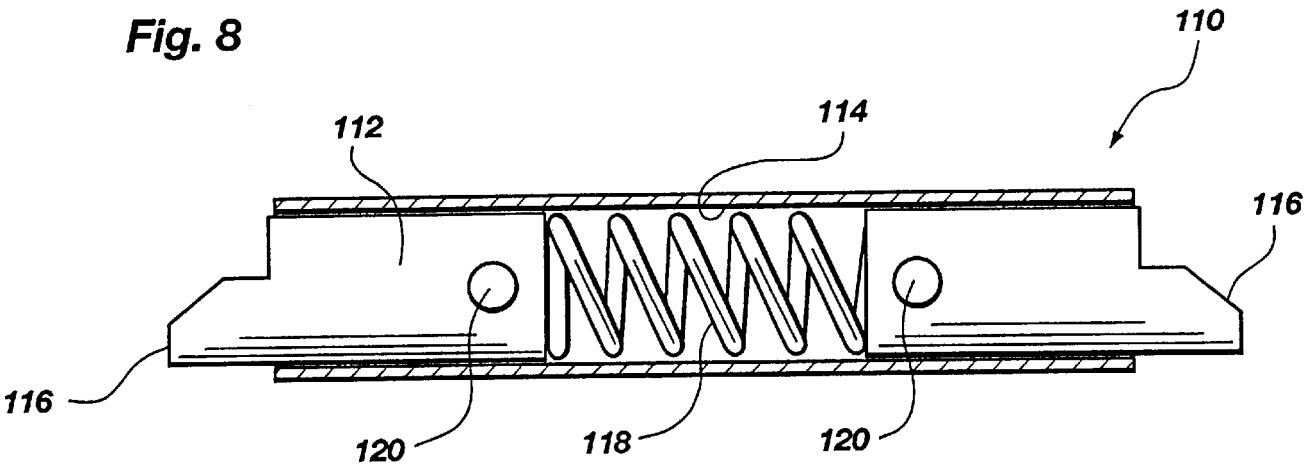
FIG. 9 is a detailed view of the cross brace locking mechanism.

As best illustrated by FIG. 9, the cross brace 110 includes a pair of latches 112 resting in a channel 114. The latches 112 are configured with a tab 116 which extends outwardly. The tabs 116 are configured to fit within the aligned holes in the telescoping supports 72. Each latch 112 is biased outwardly with a spring 118 which rests in the channel 114 between the two latches 112 such that when the holes become aligned, the tabs 116 are biased into the telescoping supports 72, preventing relative movement between the inner 74 and outer 76 members of each telescoping support 72. Each latch 112 has an actuation pin 120 which protrudes out of the channel 114 near the spring 118. The actuation pins are spaced sufficiently close to each other such that both pins can be grasped by one hand. This allows the user to squeeze the latches 112 together within the channel 114, compressing the spring 118 and withdrawing the tabs 116 out of the holes in the telescoping supports 72. This permits relative movement between the inner 74 and outer members 76 of the telescoping supports 72.

With reference now to FIGS. 5 and 6, the support pedestals are pivotally attached to the table top. The table end of each outer member 76 of each telescoping support 72 is connected to the table top by means of a first cross-pole 80. Each end of the first cross-pole 80 is positioned within holes 82 disposed within opposite sides of the table top frame 34. The first cross-pole 80, under conditions discussed below, rotates within the holes 82 and allows the support pedestals to move into a folded position. In the preferred embodiment, each telescoping support 72 is connected to the cross-pole 80 by offset brackets 84 such that when the pedestals are folded into substantially the same plane as the table top, the pedestals lie flat.

As illustrated in FIGS. 3, 4, 5, and 6, each support pedestal is also connected to the table top by a diagonal brace 96. In a preferred embodiment illustrated in FIGS. 3 and 4, the diagonal brace 96 has two angled members 98 connected at one end to a respective one of the outer members 76 of each telescoping support 72. The other end of the angled members 98 is pivotally connected to one end of a third member 100. The other end of the third member is attached to a second cross-pole 102, illustrated in FIGS. 5 and 6. Each end of the second cross-pole 102 is positioned within holes 82 disposed within opposite sides of the table top frame 34 allowing the second cross-pole 102 to rotate within the holes 82.

Referring still to FIGS. 3, 4, 5, and 6, the diagonal brace 96 can be in an extended position or folded into a collapsed position. When the diagonal brace 96 is in an extended position, the two angled members 98 and the third member 100 each have a portion 106 which overlap. The diagonal brace 96 is configured with a collar 104 sized to fit around the overlapping portion 106 when in the extended position, thus locking the diagonal brace in its extended position.

When the foldable picnic table 10 is in the upright position, as illustrated in FIG. 1, and the diagonal brace 96 is extended, the collar 104 may be placed over the overlapping portions 106 of the diagonal brace 96. In this position, the foldable picnic table 10 is ready for use. When the user desires to collapse the table for storage, a preferred method is to invert the foldable picnic table 10 as illustrated in FIG. 3. The user then depresses the push pins 88 or squeezes the actuation pins 120 together, unlocking a respective support pedestal 14, 16. This allows the inner member 74 of each telescoping support 72 to retract into the outer member 76 shortening the support pedestals 14, 16 into a retracted position as illustrated in FIG. 4.

With the support pedestals 14, 16 in the retracted position, the first axis of rotation 24 created by the pivotal connection between the first bench support member 22 and the first 18 and second 20 benches and the axis of rotation created by the pivotal connection between the pedestals 14, 16 and the table top 12 are collinear. This permits the first bench support member 22 and the first pedestal 14 to rotate about the collinear axes. In a similar fashion, the second bench support member 26 and second pedestal 16 can also rotate about collinear axes when the support pedestals 14, 16 are in the retracted position.

Figure 7:
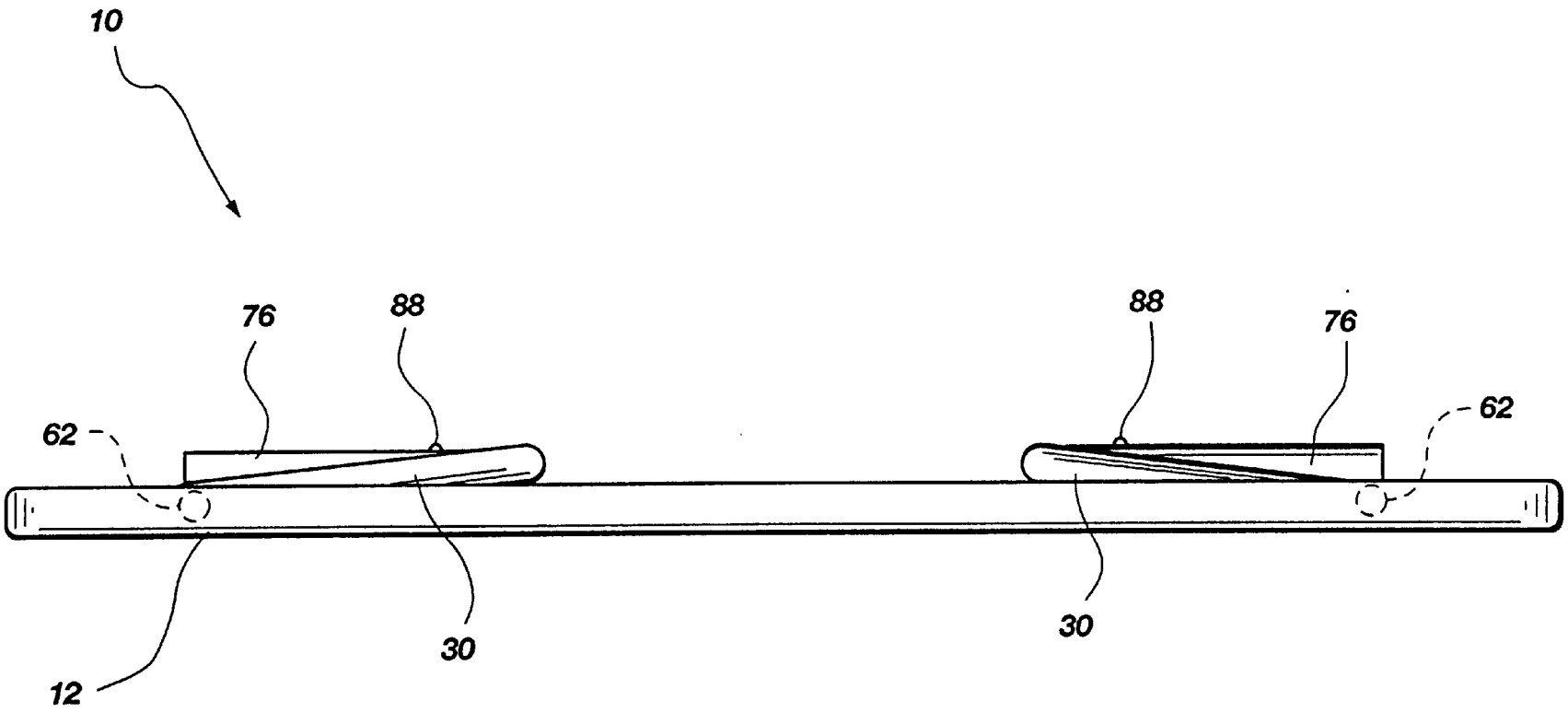
FIG. 7 is a plan side view of the foldable picnic table of FIG. 1 with the pedestals retracted and folded down onto the mounting surface of the table top.

With the foldable picnic table 10 still in the inverted position, the collar 104 may be slid away from the overlapping portion 106 as illustrated in FIG. 4. This, along with the retracted position of the pedestals 14, 16 allows the diagonal brace 96 to be folded and permits the pedestals 14, 16, together with the first 22 and second 26 bench support member, to be folded inwardly toward the table top 12, as illustrated in FIGS. 5 and 6. With the foldable picnic table 10 in a folded position as illustrated in FIG. 7, the table can easily be moved and stored.

Many of the problems associated with conventional picnic tables are addressed by the teachings of the present invention. The foldable picnic table disclosed herein does not require separate pieces to function properly. It also provides a foldable picnic table that can be folded, one side at a time, reducing the complexity of operation. Finally, the foldable picnic table maximizes the amount of leg room for a person sitting anywhere at the table.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A foldable picnic table, comprising:

a table top having a mounting surface;

a first and second bench;

a first and second support pedestal, each support pedestal pivotally attached to the table top, each support pedestal including a telescoping support having an outer member and an inner member connected in telescoping engagement, with the inner member and outer member capable of slidable movement relative to each other, thereby permitting the telescoping support to be moved linearly to thereby change the length of the support pedestal between an extended position in which the table top is positioned in a different plane than the benches and a retracted position in which the table top is positioned in substantially the same plane as the benches;

a diagonal brace connecting each support pedestal to the table top, each diagonal brace having a first bifurcated end connected to a respective one of the outer members of each telescoping support and a second opposing end connected to the mounting surface of the table top;

a first bench support member attached to the first support pedestal and pivotally attached to the first bench and to the second bench about a first axis of rotation;

a second bench support member attached to the second support pedestal and pivotally attached to the first bench and to the second bench about a second axis of rotation;

the foldable picnic table configured such that with the support pedestals in the retracted position, the axis of rotation between the first support pedestal and the table top is collinear with the first axis of rotation and the axis of rotation between the second support pedestal and the table top is collinear with the second axis of rotation, thereby permitting the bench support members and the support pedestals to be moved between a perpendicular position in which the support pedestals and bench support members are disposed perpendicular to the table top and a folded position in which the support pedestals and bench support members are folded into substantially the same plane as the table top; and means for locking the support pedestals in the extended position.

2. The foldable picnic table as defined in claim 1, wherein the table top comprises a table top frame and a table top counter, the table top counter having a functional surface and a mounting surface.

3. The foldable picnic table as defined in claim 2, wherein the functional surface of the table top counter is configured with a raised perimeter to prevent spillage off the functional surface of the table top counter.

4. The foldable picnic table as defined in claim 2, wherein the functional surface of the table top counter includes bevelled outer edges to increase the comfort of one resting an arm against the edge of the table top.

5. The foldable picnic table as defined in claim 1, wherein each bench comprises a bench frame and a bench counter, the bench counter having a sitting surface and a mounting surface.

6. The foldable picnic table as defined in claim 5, wherein the sitting surface of the bench counter is flat along its length, the sitting surface of the bench counter having bevelled outer edges.

7. The foldable picnic table as defined in claim 5, wherein the sitting surface of the bench counter is concave along its length, the sitting surface of the bench counter having bevelled outer edges.

8. The foldable picnic table as defined in claim 1, wherein each support pedestal comprises two substantially parallel telescoping supports.

9. The foldable picnic table as defined in claim 1, wherein the inner and outer members of the telescoping support comprise substantially concentric cylinders.

10. The foldable picnic table as defined in claim 1, wherein each diagonal brace is foldable, thereby allowing each support pedestal to pivot toward the table top, each diagonal brace having a lockable extended position in which relative movement between the table top and the support pedestal is substantially prevented.

11. The foldable picnic table as defined in claim 1, wherein each bench support member has two end segments joined by a substantially horizontal segment, the horizontal segment positioned substantially perpendicular to and beneath each bench, each bench having an outer longitudinal edge, the horizontal segment of each bench support extending from at least the outer longitudinal edge of the first bench to at least the outer longitudinal edge of the second bench, each end segment attached to a corresponding bench and extending outwardly to the horizontal segment, thereby leaving an unobstructed area directly beneath the bench for increased foot space.

12. The foldable picnic table as defined in claim 1, wherein the connection of the diagonal brace at its first and second ends is fixed.

13. A foldable picnic table, comprising:

a table top comprising a table top frame and a table top counter having a functional surface and a mounting surface;

a first and second bench, each comprising a bench frame and a bench counter having a sitting surface and a mounting surface;

a first and second support pedestal, each support pedestal pivotally attached to the table top, each support pedestal comprising two substantially parallel telescoping supports, each telescoping support including an inner member and an outer member connected in telescoping engagement, with the inner member and outer member capable of slidable movement relative to each other, thereby permitting the telescoping support to be moved linearly to thereby change the length of the support pedestal between an extended position in which the table top is positioned in a different plane than the benches and a retracted position in which the table top is positioned in substantially the same plane as the benches;

a diagonal brace connecting each support pedestal to the table top counter, each diagonal brace having a first bifurcated end connected to a respective one of the outer members of each telescoping support and a second opposing end connected to the mounting surface of the table top counter;

a first bench support member attached to the first support pedestal and pivotally attached to the first bench and to the second bench about a first axis of rotation;

a second bench support member attached to the second support pedestal and pivotally attached to the first bench and to the second bench about a second axis of rotation, the foldable picnic table configured such that with the support pedestals in the retracted position, the axis of rotation between the first support pedestal and the table top is collinear with the first axis of rotation and the axis of rotation between the second support pedestal and the table top is collinear with the second axis of rotation, thereby permitting the bench support members and the support pedestals to be moved between a perpendicular position in which the support pedestals and the bench support members are disposed perpendicular to the table top and a folded position in which the support pedestals and bench support members are folded into substantially the same plane as the table top; and means for locking the support pedestals in the extended position.

14. The foldable picnic table as defined in claim 13, wherein the table top frame is made of metal and wherein the table top counter is made of plastic having a functional surface configured with a bevelled outer edge to increase the comfort of one resting an arm against the edge of the table top.

15. The foldable picnic table as defined in claim 13, wherein the bench frame is made of metal and wherein the bench counter is made of plastic having a flat sitting surface along the length of the bench counter.

16. The foldable picnic table as defined in claim 13, wherein the bench frame is made of metal and wherein the bench counter is made of plastic having a sitting surface concave along the length of the bench counter.

17. The foldable picnic table as defined in claim 13, further comprising a cross brace for locking the support pedestals in an extended position, the cross brace extending between the two telescoping supports and including a pair of latches extending outwardly and into the telescoping supports to prevent relative movement between the inner and outer members of each telescoping support, each latch biased outwardly and having an actuation pin, the actuation pins spaced sufficiently close to each other such that both pins can be grasped by one hand, thereby allowing the latches to be drawn towards each other and out of the telescoping supports to permit relative movement between the inner and outer members of the telescoping supports.

18. The foldable picnic table as defined in claim 13, wherein the inner and outer members of the telescoping supports are each configured with a hole, the holes positioned to align with each other when the telescoping support is in the extended position, the table further comprising a snap pin mechanism positioned within each telescoping support to extend through the holes when they are in alignment thereby locking the telescoping supports, the snap pin mechanism being biased towards the locking position such that upon application of a sufficient force to the snap pin, the snap pin may be removed from engagement through the hole in the outer member, thereby permitting relative movement between the inner and outer members of the telescoping support.

19. The foldable picnic table as defined in claim 13, further comprising a plastic bushing between the inner and outer members of each telescoping support.

20. The foldable picnic table as defined in claim 13, wherein each diagonal brace is foldable and lockable in an extended position.

21. The foldable picnic table as defined in claim 20, wherein the diagonal brace comprises two bracing members pivotally connected to each other, the bracing members having an overlapping portion when in the extended position, each diagonal brace further including a collar sized to fit around the overlapping portion to lock the diagonal brace in the extended position.

22. A foldable picnic table, comprising:

a table top comprising a table top frame and a table top counter having a functional surface and a mounting surface;

a first and second bench, each comprising a bench frame and a bench counter having a sitting surface and a mounting surface;

a first and second support pedestal, each support pedestal pivotally attached to the table top, each support pedestal comprising two substantially parallel telescoping supports, each telescoping support including an inner member and an outer member connected in telescoping engagement, with the inner member and outer member capable of slidable movement relative to each other, thereby permitting the telescoping support to be moved linearly to thereby change the length of the support pedestal between an extended position in which the table top is positioned in a different plane than the benches and a retracted position in which the table top is positioned in substantially the same plane as the benches;

a diagonal brace connecting each support pedestal to the table top counter, each diagonal brace having a first bifurcated end connected to a respective one of the outer members of each telescoping support and a second opposing end connected to the mounting surface of the table top counter, wherein the connection of the diagonal brace at its first and second ends is fixed;

a first bench support member attached to the first support pedestal and pivotally attached to the first bench and to the second bench about a first axis of rotation;

a second bench support member attached to the second support pedestal and pivotally attached to the first bench and to the second bench about a second axis of rotation, the foldable picnic table configured such that with the support pedestals in the retracted position, the axis of rotation between the first support pedestal and the table top is collinear with the first axis of rotation and the axis of rotation between the second support pedestal and the table top is collinear with the second axis of rotation, thereby permitting the bench support members and the support pedestals to be moved between a perpendicular position in which the support pedestals and the bench support members are disposed perpendicular to the table top and a folded position in which the support pedestals and bench support members are folded into substantially the same plane as the table top; and means for locking the support pedestals in the extended position.

* * * * *